United States Patent [19]

Frettem

[11] Patent Number: 4,679,260

[45] Date of Patent: Jul. 14, 1987

[54] FLEXIBLE STRETCHER DEVICE

[76] Inventor: Peter O. Frettem, 514 W. State St., Cannon Falls, Minn. 55009

[21] Appl. No.: 758,334

[22] Filed: Jul. 24, 1985

[51] Int. Cl.[4] ..... A61G 1/00

[52] U.S. Cl. ..... 5/82 R; 5/81 R

[58] Field of Search ..... 5/82 R, 81 R, 81 B, 5/83, 89, 84; 224/156, 157

[56] References Cited

U.S. PATENT DOCUMENTS

| | | | |
|---|---|---|---|
| 338,349 | 3/1886 | Johnstone | 5/82 |
| 675,409 | 6/1901 | Pettee | 5/82 |
| 1,735,552 | 11/1929 | Strauss | 5/82 |
| 2,015,391 | 9/1935 | Anderson | 5/82 |
| 2,033,779 | 3/1936 | Monk | 5/82 |
| 2,360,371 | 10/1944 | Schwichtenberg | 5/82 |
| 2,489,828 | 11/1949 | Springer | 5/82 |
| 2,703,412 | 3/1955 | Stone | 5/82 |
| 2,766,530 | 4/1957 | Ferguson | 5/82 |
| 3,158,875 | 12/1964 | Fletcher | 5/82 |
| 3,707,734 | 1/1973 | Matthews | 5/82 |
| 3,829,914 | 8/1974 | Treat | 5/82 |
| 3,857,118 | 12/1974 | Mamo et al. | 5/81 B |
| 4,124,908 | 11/1978 | Burns et al. | 5/82 |
| 4,186,453 | 2/1980 | Burns et al. | 5/82 |

FOREIGN PATENT DOCUMENTS

| | | | |
|---|---|---|---|
| 809432 | 7/1933 | Australia | 5/89 |
| 2543473 | 3/1977 | Fed. Rep. of Germany | 5/82 |
| 378653 | 10/1907 | France | 5/89 |
| 8202512 | 1/1984 | Netherlands | 5/81 R |
| 468336 | 7/1937 | United Kingdom | 5/82 |
| 2016932 | 9/1979 | United Kingdom | 5/82 R |
| 2023010 | 12/1979 | United Kingdom | 5/82 R |
| 2041764 | 9/1980 | United Kingdom | 5/82 R |
| 2157574 | 10/1985 | United Kingdom | 5/82 R |
| 2157957 | 11/1985 | United Kingdom | 5/82 R |
| 563976 | 8/1977 | U.S.S.R. | 5/82 |

*Primary Examiner*—Gary L. Smith
*Assistant Examiner*—Carl M. DeFranco, Jr.
*Attorney, Agent, or Firm*—Anthony G. Eggink

[57] ABSTRACT

A flexible stretcher device for flexibly and adjustably transporting a human body. The flexible stretcher device is comprised of a flexible, rectalinear and elongated carrying and support body member having a top surface, a bottom surface and side edges, and having oppositely disposed elongated tubular envelope members with closing means disposed at its elongated side edges. The stretcher device further has a pair of rigid support members for placement in the elongated tubular envelope members. A pair of diagonally disposed flexible reinforcement straps are fastened to the bottom surface of the carrying body member, and a pair of elongated flexible handle member straps are fastened to the top surface of the body member. Each handle member strap is disposed parallel to and placed to the interior of the elongated tubular envelope member. The flexible stretcher device is further provided with carrying case storage means and is provided with elements to convert the stretcher into a Stokes Basket configuration for air-lift purposes.

16 Claims, 10 Drawing Figures

FLEXIBLE STRETCHER DEVICE

BACKGROUND OF THE INVENTION

This invention relates to a flexible stretcher device that is usable in emergency medical situations to pick up and transfer injured people. Particularly, the stretcher device is a compact, portable, collapsible and flexible device that is usable in a wide range of emergency situations including air lift operations, automobile, skiing, and for industrial accidents, etc.

The flexible stretcher device according to the invention is useful for safely and securely transporting an injured person. The stretcher device permits the quick and easy placement of the injured body onto the flexible stretcher, and it is easily maneuverable thereafter. The flexible body of the device is easily stored and conforms to the body of the patient when in use, and it is adaptable for either horizontal or vertical lifting of bodies. The conforming design of the flexible stretcher device holds a person rigidly, making the stretcher act as a partial body splint.

The flexible stretcher device of this invention also provides a device that can be left under a patient at a hospital or similar facility for subsequent internal transportation use to decrease the risk of further injury to the patient.

In the past, several types of stretcher or litter devices for transporting injured persons have been proposed or developed. However, these devices have generally been limited in function, have been rigid in construction, or have been designed for readily accessible accident scenes. Still others, while exhibiting some degree of flexibility, are complex in construction, difficult to manufacture and generally unsuitable for typical emergency situations.

The flexible stretcher device of this invention overcomes the limitations and shortcomings of those prior art devices. Particularly, the body conforming design of the stretcher device of this invention provides a simple, easy to manufacture, inexpensive, effective and functional device that permits a wide range of users to transport injured persons in a quickly assembled, flexible and secured manner. For example, the stretcher device permits the carrying of injured persons in horizontal as well as in vertical positions and it is designed for air lift purposes. And, despite the long standing need for such a device, none in so far as is known, has been developed.

SUMMARY OF THE INVENTION

The flexible stretcher device of the invention provides a means for flexibly and adjustably transporting a human body. It is comprised of a flexible, rectalinear and elongated carrying and support body member. The device has a top surface, a bottom surface and side edges, as well as oppositely disposed elongated tubular envelope members at its side edges and having closing means for the envelope members.

The stretcher device additionally provides a pair of rigid support members for placement in the elongated tubular envelope members. The rigid support members are provided for easy placement and securement into the tubular side edges, and they are further provided in either a unitary or a segmented construction.

The construction of the stretcher further allows for easy and rapid removal of the rigid support members, thereby allowing the stretcher support body member to be tucked under a patient which lessens the chance of an additional injury.

A pair of diagonally disposed flexible reinforcement straps are fastened to the bottom surface of the carrying body member to strengthen the device and to direct the carrying forces to the outside points of the support body so as to place the rigid tubular support members in a state of compression during use. Additionally, a pair of lift reinforcement straps are provided to further make the flexible stretcher device suitable for air lift operations.

The device is also provided with a pair of elongated flexible handle member straps fastened to the top surface of the body member and being disposed parallel to and placed to the interior of each elongated tubular envelope member. This handle configuration provides a plurality of handle segments so that the stretcher device is maneuverable in difficult to reach evacuation areas. Additionally, this configuration prevents the rigid support members from interfering with the human body being transported, while protecting the human body from exterior contact.

The stretcher device of the invention is further provided with additional elements which permit it to be used as a Stokes Basket for air lift or other single point lifting purposes. Additional elements are provided to easily carry and store the stretcher device and to further the functionality of the device itself.

These and other benefits of this invention will become clear from the following description by reference to the drawings.

DESCRIPTION OF THE PREFERRED EMBODIMENTS

Figure 1:
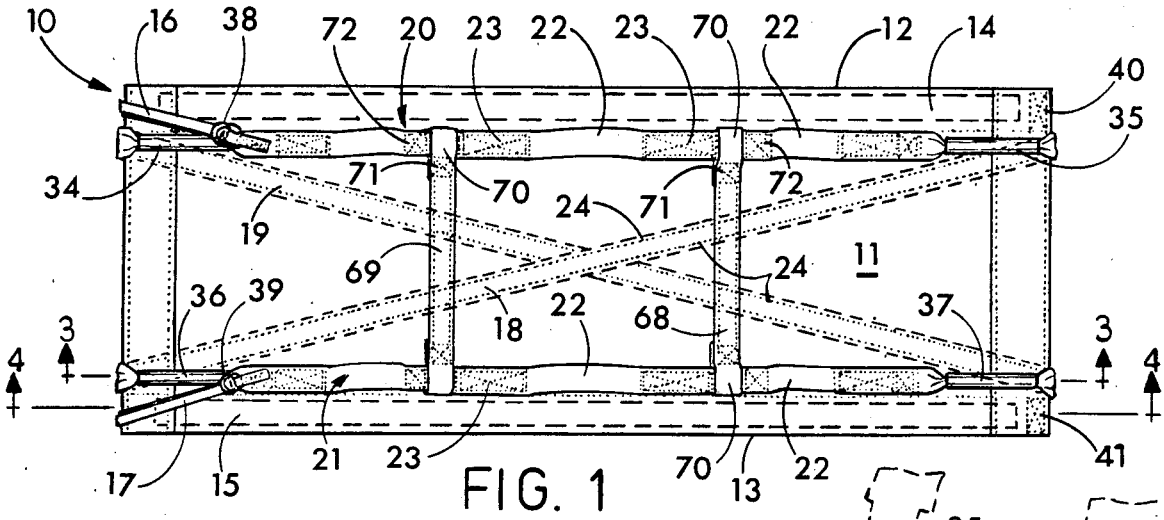
FIG. 1 is a top plan view of the flexible stretcher device of this invention.

Referring to the drawings, FIG. 1 illustrates a top view of the flexible stretcher device 10. The stretcher 10 has a rectangular flexible cover or carrying and support body member 11 and it is constructed of a polyester material for example. A typical size of the stretcher device which is usable in most emergency situations is one having a length of approximately 6 feet and a width of approximately 2.5 feet.

The cover 11 has elongated folded end flaps or tubular envelope members 12 and 13 that are secured by stitching, for example, and which receive removable tubes or rigid support members 14 and 15. The tubes 14 and 15 are preferably constructed of a lightweight (i.e., 1.25 O.D.) Aluminum or metal alloy and they are secured in the tubular envelopes 12 and 13 by closing strap means 16 and 17.

The tubular envelope members 12 and 13 have stitched ends 40 and 41 to retain the support members 14 and 15 at one of the ends. On the opposite ends, the closing strap means have sets of double O-rings 38 and 39 or a slider buckle adjustment and strap securement means, as are known in the art to secure the support tubes 14 and 15. To ensure that the rigid support members 14 and 15 do not damage or wear the flexible materials of the envelope members 12 and 13, its ends or tips 42 and 43 are preferably rounded, as is further shown in FIG. 4.

Figure 3:
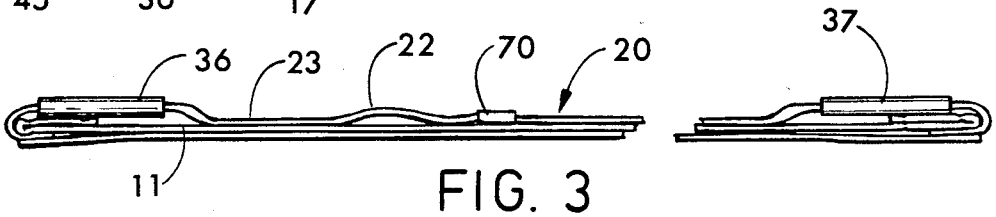
FIG. 3 is a cross-sectional view taken on lines 3—3 of FIG. 1 and showing the attachment of the elongated handle members to the rectalinear body member of the flexible stretcher device.

Importantly, attached to the support body member 11 and located to the inside of the tubular envelope members 12 and 13 are flexible handle straps 20 and 21 that are fastened to the cover 11 by stitched areas 23 which define handle segments 22. This fastening arrangement is particularly shown in FIG. 3.

The stitched or fastened portion 23 are equidistantly spaced along the handle member straps 20 and 21 to yield a plurality of handle member segments 22. The respective end handle members 22 have annular handle portions 34, 35, 36 and 37 which are preferably constructed of a flexible plastic material to further provide means of gripping by emergency personnel. Because of the flexible nature of the stretcher and the multiple handles 22 and 30, a patient can be transported at a 45 degree verticle angle, for example. Particularly, as shown in FIG. 2, lifting on the handle portions 34, 35, 36 and 37 folds the material over the rigid support memberts 14 and 15, ensuring closure of the tubular envelope members 12 and 13.

Below or underneath the cover 11 are stitched diagonal reinforcement straps 18 and 19. Both handle straps 20 and 21 and the reinforcement straps 18 and 19 are preferably constructed of polyester seat belt type material or the like. The diagonal reinforcement straps 18 and 19 are fastened to the support body member 11 by stitching or fastening lines 24.

A pair of lift reinforcement straps 68 and 69 are further provided for fastening to the top of the support body member 11. The reinforcement straps 68 and 69, respectively, have looped ends 70, with stitched end portions 71, which are loosely fitted about the respective handle member straps 20 and 21. Adjacent the looped ends 70 are securement stitched portions 72 to fix the looped ends 70 between it and the stitched areas 23.

Figure 2:
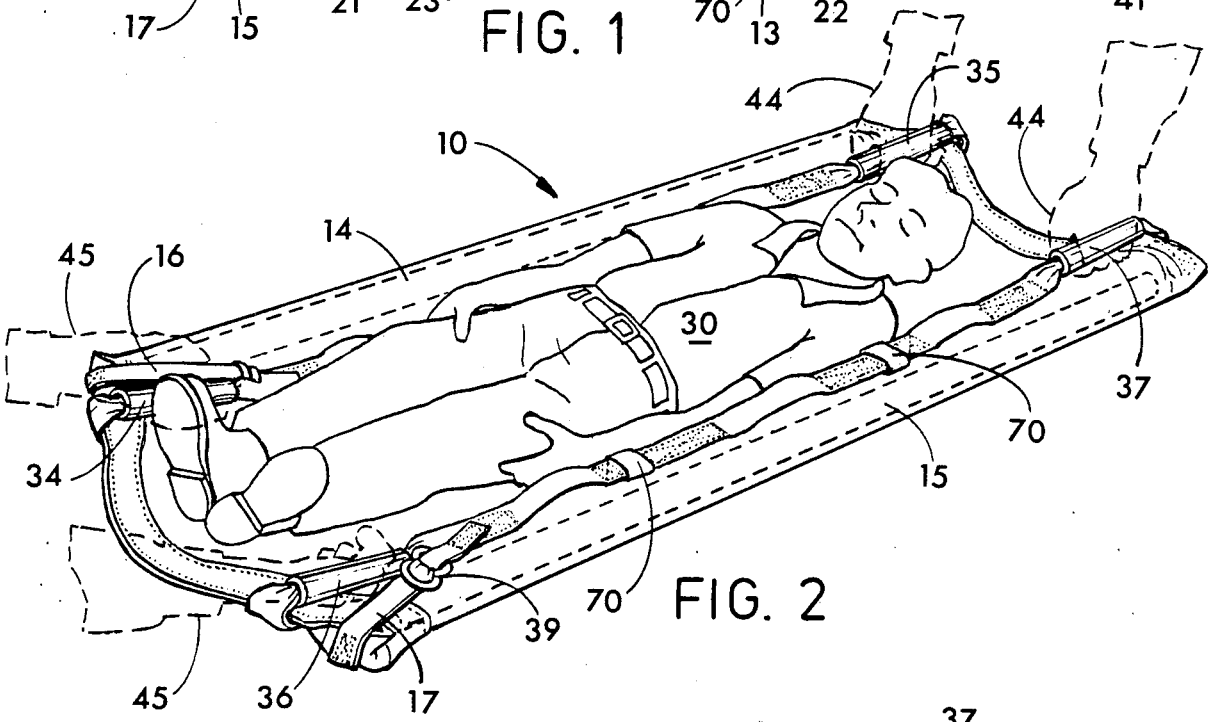
FIG. 2 is a top perspective view of the flexible stretcher device of FIG. 1 and showing a human body placed thereon and being transported at the handle portions of its elongated handle members.

FIG. 2 shows a human body 30 being transported on the flexible stretcher device 10. As shown, the hands 44 and 45 of two ambulance attendants, for example, grasp the annular handle portions 34, 35, 36 and 37. This arrangement permits the stretcher 10 to be maneuvered down stairs, for example.

The rigid support members 14 and 15 provide a means of protection outside the body 20 being carried. And, the location of the flexible handle straps 20 and 21 being to the inside of the rigid members 14 and 15, they do not interfere with the comfort of the patient or with the ability of the handle member segments 22 being grasped.

When the stretcher device 10 is used with a human body 30 being transported, the rigid members 14 and 15 are essentially placed in a state of compression to thereby absorb most of the resultant forces due to carrying the body on the stretcher surface.

Figure 5:
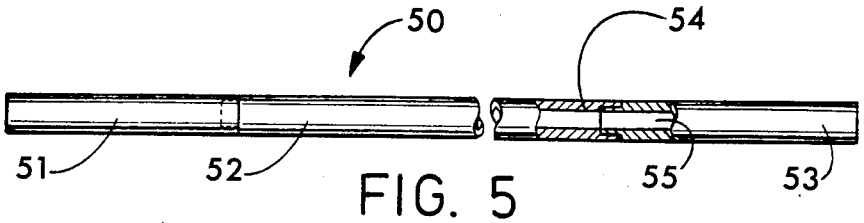
FIG. 5 is a lateral view with cut-away portions of a rigid support member embodiment and particularly showing the attachment means of the respective segments of the support members.

FIG. 5 is another embodiment of the rigid members that can be used with the stretcher of the invention. The rigid members thus far discussed have been one piece elements. However, they can also be telescoping in nature. And, FIG. 5 shows a segmented tube member 50 having tubular segments 51, 52 and 53.

The individual tube segments are preferably color coded, i.e. green, yellow and red, and they respectively have female ends 52 and mating male ends 52 for quick assembly. Because of the compressive nature of the resultant forces during use, the frictional fit of the individual segments are preferable.

Figure 6:
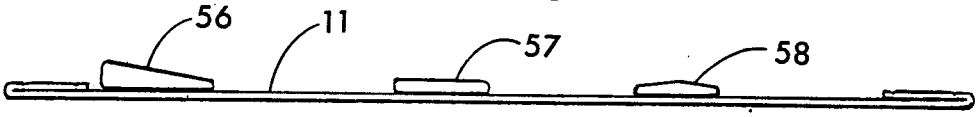
FIG. 6 is a lateral view of the flexible stretcher device carrying member of this invention having head, body and leg support members attached thereto.

FIG. 6 illustrates the optional use of an inclined head support pillow 56, a back support member 57 and a leg support member 58. These elements can be quickly attached to the top of the body member 11 by a fastening means such as Velcro fasteners.

Figure 7:
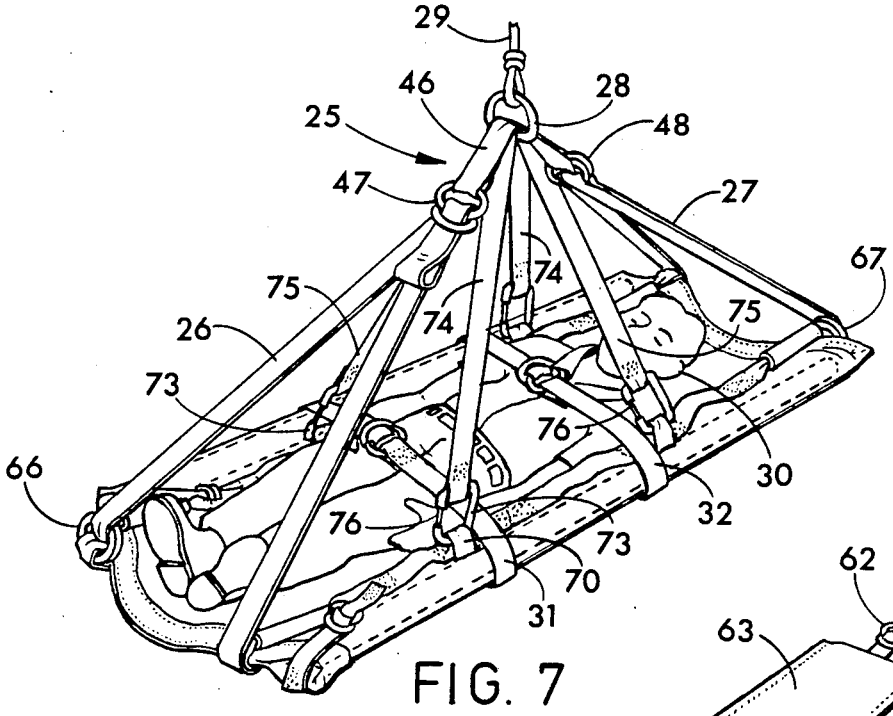
FIG. 7 is a perspective view of the flexible stretcher device of this invention being used in a Stokes Basket configuration.

FIG. 7 is a perspective view of the flexible stretcher of the invention being used in a Stokes Basket configuration 25. This configuration is suitable for air lift purposes, i.e. for ski accidents, removing bodies out of smoke stacks, or transporting injured people from remote areas.

The Stokes Basket configuration 25 utilizes the shoulder/stabilizing straps or lifting loops 26 and 27 that are preferably attached or contiguous with the diagonal reinforcement straps 18 and 19.

The shoulder stabilizing straps 26 and 27 are shown in FIG. 7 in use with the Stokes Basket configuration 25. However, these straps 26 and 27 are usable without the attachment strap 46 in that they permit the front and rear attendants of the stretcher to place the staps 26 and 27 about their respective shoulders to further stabilize the stretcher device during use. This is particularly important if transport is required in angular or inclined situations such as the transport of a body 30 out of a ravine or up and down stairways. For the latter situations, adjustment ring sets 66 and 67 are provided to permit the lifting straps 26 and 27 to be adjusted to a proper length to accomodate the angle of carry or the physical size of the attendants.

At the top of the lifting loops 26 and 27 is an attachment strap 46 having a pair of double O-rings 47 and 48 or a slider buckle for attachment to the lifting loops 26 and 27. At the center of the attachment strap 46 is a D-ring 28 that is attachable to a lift line 29 that extends from a helicopter, for example.

As is further shown in FIG. 7, a pair of fixed length lifting straps 74 and 75 are provided having parachute type fasteners or caribiners 76 having hinged portions 76. The latter type fasteners 76, or any quickly engaging fastener as is known in the art, engage the looped ends 70 to provide the flexible stretcher device with additional strength and stability during air lift operations.

The configuration as shown in FIG. 7 also permits the stretcher to be lifted in a vertical configuration by placing the fasteners 73 into the same lower opposing loops 70 and by utilizing the double O-rings 48, or similar type rings, as the lifting point of the stretcher. This configuration permits injured persons to be lifted out of smoke stacks, for example. And, the strap configurations of this embodiment cause the stretcher to form a funnel-type shape to secure the body 30 therein.

FIG. 7 further shows the human body 30 secured to the stretcher device by securement straps 31 and 32. The latter straps utilize double O-rings or a slider buckle for fastening and these straps can be placed through or underneath handle member segments 22 to further provide a secure transport arrangement for the human body 30 during air lift.

Figure 8:
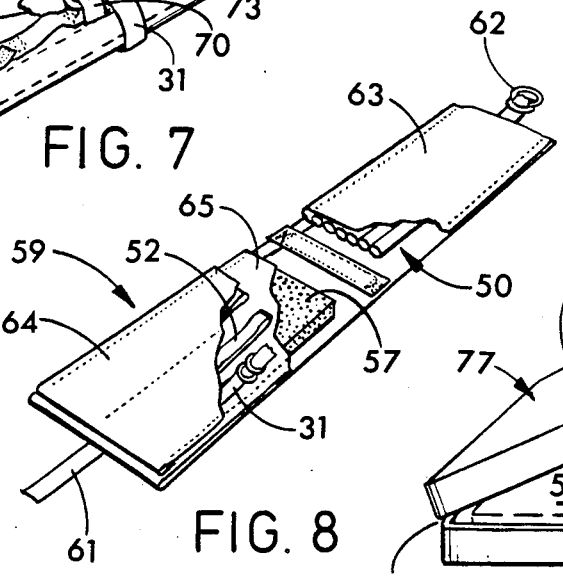
FIG. 8 is a perspective view of the carrying bag of this invention with cut-away portions showing the various elements of the flexible stretcher device stored therein.
Figure 9:
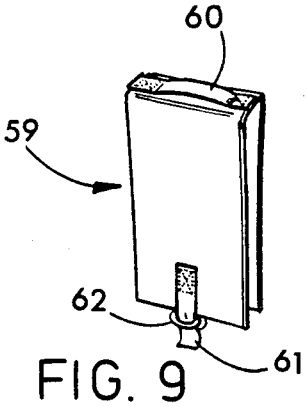
FIG. 9 is a perspective view of the carrying bag of FIG. 8 shown in a closed configuration.

FIG. 8 shows a carrying bag 59 for the various components and accessories of the flexible stretcher device 10. The carrying bag 59 is shown in a closed configuration in FIG. 9.

The bag 59 has pocket portions 63, 64 and 65 for respectively receiving segmented tubular members 50, securement straps 31 and 32, and back support member 57. The bag 59 further has a handle member 60, a closing strap 61 and a double O-ring closure 62.

Figure 10:
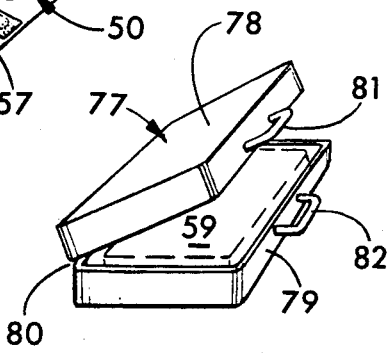
FIG. 10 is a perspective view of the watertight and floatable plastic storage case for the stretcher device of this invention.

FIG. 10 illustrates a storage case 77 for the flexible carrying bag 59 and it contents. The storage case 77 has a top portion 78, a bottom portion 79, a hinge 80 and handles 81 and 82. The storage case 77 is preferably a plastic watertight and floatable container for purposes of protecting the carrying bag 59 during times of storage. For the stretcher dimensions discussed above, a storage case 77 having a length of 22 inches, a width of 10 inches and a depth of 5½ inches has been found suitable.

Because of the lift reinforcement straps 68 and 69 and the diagonal reinforcement straps 18 and 19 it is possible to manufacture the support body member 11 of a netted-type polyester or similar material.

Figure 4:
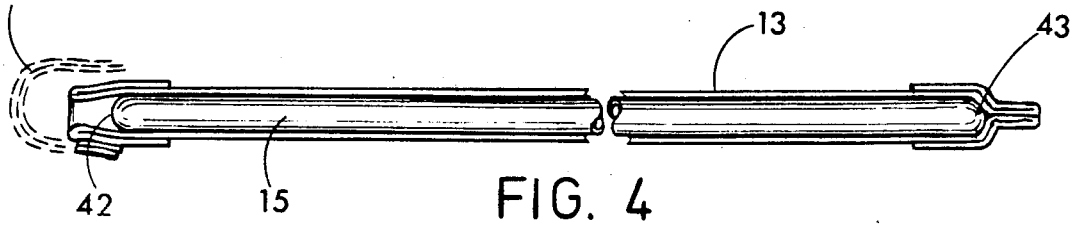
FIG. 4 is a cross-sectional view taken on lines 4—4 of FIG. 1 and showing the rigid support member being inside the elongated tubular envelope member thereof.

In use, the stretcher device initially has its tubes 14 and 15 removed and the flexible body or cover 11 rolled or folded for storage purposes. The tubes can be single pieces, telescoping or sectional segments and preferably have rounded or bullet type ends, as shown in FIG. 4, to prevent cutting or wearing the flexible cover 11. Additionally the end portions of the body support member can have added thickness areas stitched to further secure the rigid support members.

The flexible cover 11 is easily slid underneath an injured person and then the tubes 14 and 15 are placed into flap ends 12 and 13 and then secured by closing straps 16 and 17. Next, the emergency personnel can grasp any of the handles 22 or handle portions 35, 36, 37 and 38, to move the patient with the stretcher conforming to the body.

Shoulder straps 26 and 27 aid balance while carrying over rough or uneven terrain or down stairways, thus the forward carrying attendant can walk forward, as can the rear attendant.

It is preferred that all weight bearing elements of the stretcher device be constructed of metal or metal alloys to accomodate temperature changes without loss of strength. These elements include 28, 38, 39, 47, 48, 66, 67 and 73.

As mentioned, it is important that the handle straps 20 and 21 are on the inside of the tubes 14 and 15 because upon lifting the stretcher, the opposing rigid tubes of the stretcher do not interfere with the handle members and they provide an exterior protection to the patient.

As many changes are possible to the embodiments of the stretcher device utilizing the teachings of the invention, the descriptions above and the accompanying drawings should be interpreted in the illustrative and not in the limited sense.

That which is claimed is:

1. A flexible carrying device for flexibly and adjustably transporting a human body, said flexible stretcher device comprising:

a. a flexible, rectilinear and elongated body support member having a top surface, a bottom surface and folded side edges, each of said folded side edges forming elongated tubular envelope members, each of said elongated tubular envelope members having a predetermined diameter and having an open end and a closed secured end opposite said open end, each of said envelope members further having closing and tightening strap means fixed to said flexible body member in proximity to said open end, b. a pair of rigid tubular members for placement in said elongated tubular envelope members, each support member having a diametric dimension smaller than the predetermined diameter of said tubular envelope member and having a length that is less than the length of said body member, said closing and tightening strap means being folded over said open end of said tubular envelope member to securely hold said rigid support member within said tubular envelope member, c. a pair of diagonally disposed flexible reinforcement straps fastened to the bottom surface of said carrying body member and being generally disposed diagonally across said bottom surface in a generally central cross-over configuration and extending to the opposite ends of said rectilinear body support member, said diagonal flexible straps terminating interiorly proximate the respective ends of said tubular envelope members, said diagonally disposed straps being constructed and arranged to transfer the weight of the human body placed on said stretcher device to the ends of said flexible body member and on to the ends of said rigid support members to put said rigid support members in a state of compression, and d. a pair of oppositely disposed elongated flexible handle member straps fastened to said top surface of said body member and extending generally the length of said body support member, each of said handle member strap further being disposed parallel to and interiorly of each said elongated tubular envelope member, each of said handle member straps being connected to said diagonally disposed flexible reinforcement straps, whereby, the placement of a human body on said body support member causes compressive forces to be exerted on said rigid support members by means of said diagonally disposed reinforcement straps and said envelope members secured about the rigid support members.

2. The flexible stretcher device of claim 1, wherein said oppositely disposed flexible handle member straps are fastened to said flexible body member at a plurality of equidistantly disposed intervals to form a plurality of handle portions.

3. The flexible stretcher device of claim 2, wherein said handle portions have front and rear handle portions and wherein said front and rear handle portions further have annular flexible gripping portions disposed thereabout.

4. The flexible stretcher device of claim 1, wherein said rigid tubular members are comprised of a plurality of segmented tubular portions having male and female end portions for frictional securement.

5. The flexible stretcher device of claim 4, wherein said rigid tubular members are comprised of at least three segmented tubular portions, one said outside segmented portion being green, said center portions being yellow and the other said outside segmented portion being red, said green and red segmented end portions further having rounded end tip portions.

6. The flexible stretcher device of claim 1, wherein said device further has a pair of opposing stabilizing straps extending from the end portions of said rectilinear body member so as to form a pair of looped strap members at the opposing ends of said body member for shoulder carrying and stabilizing purposes.

7. The flexible stretcher device of claim 6, wherein said device additionally has an attachement strap element having double O-rings attached at its ends and a D-ring attached intermediate said double O-ring ends, said attachment strap element for securement to said oppositely disposed looped members for forming a Stokes Basket for lifting purposes.

8. The flexible stretcher device of claim 1, wherein said device additionally has a pair of securement straps having fastening means for placing about a human body to further secure the human body to said carrying body member.

9. The flexible stretcher device of claim 1, wherein said device additionally has a flexible carrying bag having a plurality of pocket portions to store said elements of said device, and wherein a watertight and floatable storage case is provided for receiving said carrying bag.

10. The flexible stretcher device of claim 1, wherein said flexible body member, said elongated tubular envelope members, said diagonal reinforcement straps and said flexible handle members are comprised of a polyester material.

11. The flexible stretcher device of claim 1 wherein a pair of lift reinforcement straps are disposed across said body member, said reinforcement straps having loose looped end portions annularly disposed about centrally opposing handle member strap portions.

12. The flexible stretcher device of claim 11, wherein said device further has a pair of opposing stabilizing straps extending from the end portions of said rectilinear body member so as to form a pair of looped strap members at the opposing ends of said body member for shoulder carrying and stabilizing purposes.

13. The flexible stretcher device of claim 12, wherein said device additionally has an attachment strap element having fastening means attached at its ends and a D-ring element attached intermediate said fastening means, said attachment strap element being for securement to said pair of oppositely disposed loose looped end portions of said lift reinforcement straps for forming a Stokes Basket for lifting purposes.

14. The flexible stretcher device of claim 13 wherein said pair of lifting straps have a predetermined length and are provided for diagonally extending through said D-ring member, said lifting straps further having fasteners attached at their respective ends for the removable securement to said looped end portions annularly disposed about said centrally opposing handle member strap portions.

15. A flexible stretcher device for flexibly and adjustably transporting a human body, said carrying device being constructed and arranged for vertical lifting purposes, said flexible carrying device comprising:

a. a flexible, rectilinear body support member having a top surface, a bottom surface and folded side edges to form elongated tubular envelope members, said tubular envelope members having a predetermined diameter, a closed secured end, and an open end opposite said closed ends, said envelope members further having closing and tightening strap means disposed at said open ends, and fixed to said body support member in proximity to said open ends said body support member further having a pair of diagonally disposed flexible reinforcement straps fastened to a bottom surface thereof in a generally central cross-over configuration and extending to the opposite ends of said body support member at locations interiorly proximate the respective ends of each of said envelope members, said diagonally disposed straps being constructed and arranged to transfer the weight of the human body to each of said envelope member ends, b. a pair of rigid support members for the removable insertion in said elongated tubular envelope members, each support member having a diametric dimension smaller than said predetermined diameter of said tubular envelope member and having a length that is less than the length of said body member, each of said rigid support members being secured within said envelope member by said closing and tightening strap means which receive and assume compressive forces by means of said diagonally disposed straps, c. a pair of elongated flexible handle member straps fastened to said top surface of said body member and extending the length of said body member, each of said handle member straps being disposed parallel to and to the inside of each of said elongated tubular envelope member, each of said handle members straps further having two spaced lifting loops attached thereto intermediate their respective lengths each of said handle member straps being connected to said diagonally disposed flexible reinforcement straps, d. a pair of opposed stabilizing straps, each being fastened to the ends of said diagonally disposed straps and extending from the outer end portions of said rectilinear body member so as to form a pair of looped strap members at each opposing end of said body member, e. a pair of lifting straps each having a predetermined length and having quickly engaging fasteners releasably fixed to the ends thereof for attachment to opposite diagonally disposed lifting loops attached to said handle member straps, and f. an attachment strap element having double O-rings attached at its ends and a D-ring attached intermediate said double O-ring ends, said double O-rings being for the adjustable securement to said oppositely disposed looped strap members and said pair of lifting straps being for extension through said D-ring for forming a Stokes Basket for vertical lifting purposes.

16. The flexible stretcher device of claim 15 wherein said quickly engaging fasteners fixed to the ends of said lifting straps are caribiners.

* * * * *